US008087187B2

(12) United States Patent
Aveni et al.

(10) Patent No.: US 8,087,187 B2
(45) Date of Patent: Jan. 3, 2012

(54) ARTICLE OF FOOTWEAR WITH SUPPORT ASSEMBLIES

(75) Inventors: Michael A. Aveni, Lake Oswego, OR (US); Thomas McGuirk, Lake Oswego, OR (US); Danielle L. Taylor, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 634 days.

(21) Appl. No.: 12/265,878

(22) Filed: Nov. 6, 2008

(65) Prior Publication Data

US 2010/0107445 A1 May 6, 2010

(51) Int. Cl.
*A43B 13/20* (2006.01)
*A43B 13/14* (2006.01)

(52) U.S. Cl. ..... 36/28; 36/29; 36/35 B

(58) Field of Classification Search ..... 36/28, 29, 36/25 R, 35 R, 35 B, 37
See application file for complete search history.

(56) References Cited

U.S. PATENT DOCUMENTS

| | | | |
|---|---|---|---|
| 4,183,156 | A | 1/1980 | Rudy |
| 4,219,945 | A | 9/1980 | Rudy |
| 4,340,626 | A | 7/1982 | Rudy |
| 4,486,964 | A | 12/1984 | Rudy |
| 4,506,460 | A | 3/1985 | Rudy |
| 4,779,359 | A | 10/1988 | Famolare, Jr. |
| 4,906,502 | A | 3/1990 | Rudy |
| 4,936,029 | A | 6/1990 | Rudy |
| 4,999,931 | A | 3/1991 | Vermeulen |
| 5,042,176 | A | 8/1991 | Rudy |
| 5,083,361 | A | 1/1992 | Rudy |
| 5,220,737 | A | 6/1993 | Edington |
| 5,543,194 | A | 8/1996 | Rudy |
| 5,686,167 | A | 11/1997 | Rudy |
| 5,713,141 | A | 2/1998 | Mitchell et al. |
| 5,741,568 | A | 4/1998 | Rudy |
| 5,753,061 | A | 5/1998 | Rudy |
| 5,916,664 | A | 6/1999 | Rudy |
| 5,952,065 | A | 9/1999 | Mitchell et al. |
| 5,993,585 | A | 11/1999 | Goodwin et al. |
| 6,013,340 | A | 1/2000 | Bonk et al. |
| 6,029,962 | A | 2/2000 | Shorten et al. |
| 6,082,025 | A | 7/2000 | Bonk et al. |
| 6,119,371 | A | 9/2000 | Goodwin et al. |
| 6,127,010 | A | 10/2000 | Rudy |
| 6,127,026 | A | 10/2000 | Bonk et al. |
| 6,158,149 | A | 12/2000 | Rudy |
| 6,203,868 | B1 | 3/2001 | Bonk et al. |

(Continued)

FOREIGN PATENT DOCUMENTS

| | | | |
|---|---|---|---|
| GB | 2206475 | A | 1/1989 |

(Continued)

OTHER PUBLICATIONS

International Search Report and Written Opinion issued Mar. 4, 2010 in corresponding PCT Application No.: PCT/US2009/063190.

(Continued)

*Primary Examiner* — Marie Patterson
(74) *Attorney, Agent, or Firm* — Banner & Witcoff, Ltd.

(57) ABSTRACT

An article of footwear includes an upper and a sole assembly secured to the upper. The sole assembly includes a top plate, a bottom plate positioned below the top plate, and a plurality of support assemblies extending between the upper plate and the midsole. Each support assembly includes a fluid-filled bladder and a retaining member surrounding the fluid-filled bladder.

23 Claims, 4 Drawing Sheets

U.S. PATENT DOCUMENTS

| | | | | |
|---|---|---|---|---|
| 6,321,465 | B1 | 11/2001 | Bonk et al. | |
| 6,457,263 | B1 | 10/2002 | Rudy | |
| 6,487,796 | B1 | 12/2002 | Avar et al. | |
| 6,665,958 | B2 | 12/2003 | Goodwin | |
| 6,837,951 | B2 | 1/2005 | Rapaport | |
| 6,898,870 | B1 | 5/2005 | Rohde | |
| 6,944,973 | B2 * | 9/2005 | Goodwin | 36/29 |
| 6,964,120 | B2 | 11/2005 | Cartier et al. | |
| 7,070,845 | B2 | 7/2006 | Thomas et al. | |
| 7,076,891 | B2 | 7/2006 | Goodwin | |
| 7,086,179 | B2 | 8/2006 | Dojan et al. | |
| 7,086,180 | B2 | 8/2006 | Dojan et al. | |
| 7,100,310 | B2 | 9/2006 | Foxen et al. | |
| 7,131,218 | B2 | 11/2006 | Schindler | |
| 7,141,131 | B2 | 11/2006 | Foxen et al. | |
| 7,314,125 | B2 | 1/2008 | Smaldone et al. | |
| 7,360,324 | B2 * | 4/2008 | Aveni | 36/27 |
| 7,458,172 | B2 | 12/2008 | Aveni | |
| 7,484,317 | B2 | 2/2009 | Kita et al. | |
| 7,685,742 | B2 * | 3/2010 | Aveni et al. | 36/27 |
| 7,730,635 | B2 * | 6/2010 | Aveni et al. | 36/27 |
| 7,757,410 | B2 * | 7/2010 | Aveni et al. | 36/28 |
| 7,802,378 | B2 * | 9/2010 | Harmon Weiss et al. | 36/28 |
| 2003/0051373 | A1 | 3/2003 | Goodwin | |
| 2005/0167029 | A1 | 8/2005 | Rapaport et al. | |
| 2006/0112592 | A1 * | 6/2006 | Leedy et al. | 36/29 |
| 2006/0130365 | A1 | 6/2006 | Sokolowski et al. | |
| 2007/0063368 | A1 | 3/2007 | Schindler | |
| 2007/0074423 | A1 | 4/2007 | Goodwin et al. | |
| 2007/0119074 | A1 | 5/2007 | Aveni et al. | |
| 2007/0193065 | A1 | 8/2007 | Nishiwaki et al. | |
| 2007/0266592 | A1 | 11/2007 | Smith et al. | |
| 2008/0016719 | A1 | 1/2008 | Aveni et al. | |
| 2008/0016720 | A1 | 1/2008 | Aveni et al. | |
| 2008/0034615 | A1 | 2/2008 | Nishiwaki | |
| 2008/0098619 | A1 | 5/2008 | Smaldone et al. | |
| 2009/0100705 | A1 * | 4/2009 | Cook et al. | 36/29 |
| 2009/0165333 | A1 | 7/2009 | Litchfield et al. | |

FOREIGN PATENT DOCUMENTS

| | | | |
|---|---|---|---|
| WO | 2009067424 | A2 | 5/2009 |

OTHER PUBLICATIONS

International Search Report and Written Opinion issued Mar. 4, 2010 in corresponding PCT Application No.: PCT/US2009/063195.

International Preliminary Report on Patentability issued May 19, 2011 in corresponding PCT Application No. PCT/US2009/063190.

International Preliminary Report on Patentability issued May 19, 2011 in corresponding PCT Application No. PCT/US2009/063195.

Office Action issued Sep. 14, 2011 in related U.S. Appl. No. 12/265,881.

* cited by examiner

ARTICLE OF FOOTWEAR WITH SUPPORT ASSEMBLIES

FIELD OF THE INVENTION

This invention relates generally to footwear, and, in particular, to footwear with support assemblies having fluid-filled bladders and retaining members encasing the fluid-filled bladders.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an article of footwear with support assemblies having fluid-filled bladders and retaining members encasing the fluid-filled bladders that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide footwear with support assemblies having fluid-filled bladders and retaining members encasing the fluid-filled bladders. In accordance with a first aspect, an article of footwear includes an upper and a sole assembly secured to the upper. The sole assembly includes a top plate, a bottom plate positioned below the top plate, and a plurality of support assemblies extending between the upper plate and the midsole. Each support assembly includes a fluid-filled bladder and a retaining member surrounding the fluid-filled bladder.

In accordance with another aspect, an article of footwear includes an upper and a sole assembly secured to the upper. The sole assembly includes a top plate having a plurality of projections on a lower surface thereof, a bottom plate positioned below the top plate and having a plurality of projections on an upper surface thereof, and a plurality of support assemblies extending between the top plate and the bottom plate. Each support assembly includes a fluid-filled bladder having a first surface, an opposed second surface, and a tensile member joined to the first and second surfaces. A retaining member includes a plurality of panels spaced from one another and defining gaps therebetween, each panel being connected at a first end thereof to a first plate and at second ends thereof to one of a plurality of second plates, the retaining member surrounding the fluid-filled bladder, the first plate having a central aperture therein, each of the second plates having a recess, and the recesses defining a central aperture.

In accordance with a further aspect, an article of footwear includes an upper and a sole assembly secured to the upper. The sole assembly includes a top plate having a plurality of projections on a lower surface thereof, and a bottom plate positioned below the top plate and having a plurality of projections on an upper surface thereof. A plurality of support assemblies extends between the top plate and the bottom plate. Each support assembly includes a fluid-filled bladder having a first surface, an opposed second surface, and a tensile member joined to the first and second surfaces, the tensile member being formed from a textile material that includes a first wall bonded to the first surface, a second wall bonded to the second surface, and a plurality of connecting members extending between the first wall and the second wall. A retaining member includes a plurality of panels spaced from one another and defining gaps therebetween, with each panel being connected at a first end thereof to a first plate and at second ends thereof to one of a plurality of second plates. The retaining member surrounds the fluid-filled bladder, with the first plate having a central aperture therein, and each of the second plates having a recess, the recesses defining a central aperture. An outsole is secured to a lower surface of a lower surface of the bottom plate.

Substantial advantage is achieved by providing footwear with support assemblies having fluid-filled bladders and retaining members encasing the fluid-filled bladders. In particular, certain embodiments provide enhanced support and cushioning for the user.

These and additional features and advantages disclosed here will be further understood from the following detailed disclosure of certain embodiments.

Figure 1:
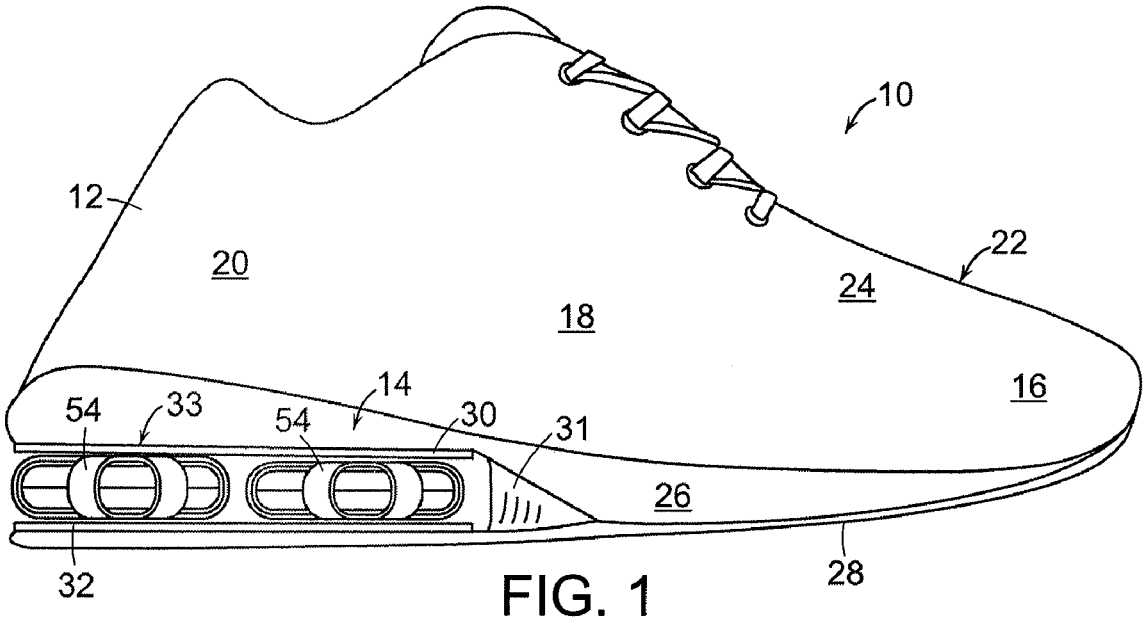
FIG. 1 is a side elevation view of an article of footwear with a plurality of support assemblies having fluid-filled bladders and retaining members.

The figures referred to above are not drawn necessarily to scale, should be understood to provide a representation of particular embodiments of the invention, and are merely conceptual in nature and illustrative of the principles involved. Some features of the article of footwear with support assemblies having fluid-filled bladders and retaining members encasing the fluid-filled bladders depicted in the drawings have been enlarged or distorted relative to others to facilitate explanation and understanding. The same reference numbers are used in the drawings for similar or identical components and features shown in various alternative embodiments. Articles of footwear with support columns and retaining members as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a sole structure for an article of footwear. The sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 2:
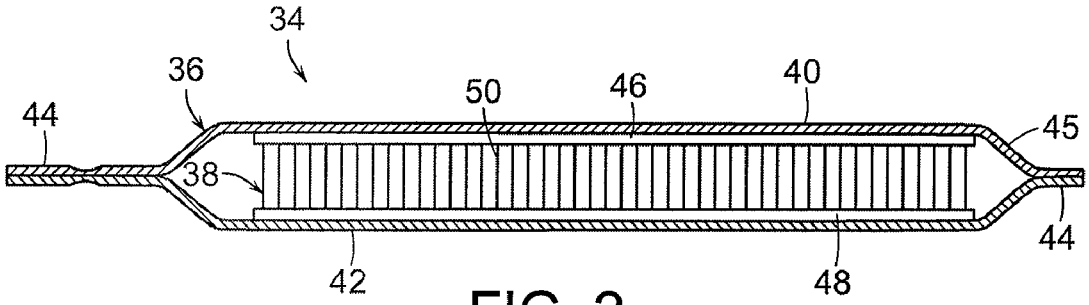
FIG. 2 is a sectional view of a fluid-filled bladder of the article of footwear of FIG. 1.

An article of footwear 10 is depicted in FIG. 1 as including an upper 12 and a sole assembly 14. For reference purposes, footwear 10 may be divided into three general portions: a forefoot portion 16, a midfoot portion 18, and a heel portion 20, as shown in FIGS. 1 and 2. Footwear 10 also includes a lateral side 22 and a medial side 24. Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10.

Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole assembly 14, and individual elements thereof.

The figures illustrate only an article of footwear intended for use on the left foot of a wearer. One skilled in the art will recognize that an article of footwear for the right foot of a wearer, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole assembly 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is attached to upper 12 and functions as the primary shock-attenuating and energy-absorbing component of footwear 10. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole assembly 14 may not include an outsole layer separate from midsole 26 but, rather, the outsole may comprise a bottom surface of midsole 26 that provides the external traction surface of sole assembly 14.

Sole assembly 14 includes a first, or top plate 30 positioned beneath a portion of midsole 26. In the illustrated embodiment, top plate 30 extends rearwardly from a midfoot portion 18 of midsole 26. A second, or bottom plate 32 is positioned below top plate 30 and above outsole 28. A wedge portion 31 is positioned forwardly of top plate 30 and bottom plate 32, between midsole 26 and outsole 28 in a midfoot portion 18.

Top plate 30 and bottom plate 32 can be formed of any desired material. Suitable materials include plastics, elastomers, carbon-filled materials, a polyether block copolyamide (sold as Pebax® by ATOFINA Chemicals of Philadelphia, Pa.), a blend of a polyether block copolyamide with another material (such as glass-filled nylon, carbon-filled materials, polyamides, or poly-paraphenylene terephthalamides), thermoplastic polyurethane (TPU), or other materials. Other suitable materials for top plate 30 and bottom plate 32 will become readily apparent to those skilled in the art, given the benefit of this disclosure.

In the illustrated embodiment, bottom plate 32 extends rearwardly from a midfoot portion 18 of midsole 26. It is to be appreciated that top plate 30 and bottom plate 32 may extend over any desired portion of footwear 10. A plurality of support assemblies 33 is positioned between top plate 30 and bottom plate 32. In the illustrated embodiment, four support assemblies 33 are positioned between top plate 30 and bottom plate 32, with only two support assemblies 33 on medial side 24 of sole assembly 14 being visible in FIG. 1, and two support assemblies 33 on lateral side 22 of sole assembly being blocked from view in this figure.

It is to be appreciated that sole assembly 14 can include any number of support assemblies 33, and that support assemblies 33 need not necessarily be positioned in heel portion 20 of sole assembly 14. One or more support assemblies 33 can be positioned in one or more of heel portion 20, midfoot portion 18, and/or forefoot portion 16 of sole assembly 14.

Each support assembly 33 includes a fluid-filled bladder 34, which is a sealed member that encloses a pressurized fluid, as depicted in FIG. 2. Bladder 34 includes an outer barrier 36 and a tensile member 38 enclosed within outer barrier 36. Outer barrier 36 may be formed of a polymer material and includes a first barrier layer 40 and an opposite second barrier layer 42, each of which is substantially impermeable to the fluid within bladder 34. First barrier layer 40 and second barrier layer 42 are bonded together around their respective peripheries to form a peripheral bond 44 and cooperatively form a sealed chamber, in which the pressurized fluid is located. First barrier layer 40 forms an upper surface and a portion of a sidewall of bladder 34, and second barrier layer 42 forms a lower surface and another portion of the sidewall of bladder 34. This configuration positions peripheral bond 44 at a midpoint of the sidewall. Alternately, peripheral bond 44 may be positioned adjacent to the lower surface or the upper surface to promote visibility through the sidewall. Accordingly, the specific configuration of outer barrier 36 may vary significantly within the scope of the present invention.

Support columns 32 provide a low profile and resilient support structure for footwear 10. Support columns can be used in place of many support structures in order to provide a lower profile, yet resilient support structure. For example, support columns 32 can be used in place of support structures found in footwear such as spring members, elastomeric support columns, impact-attenuating elements/members, support elements, and other elements that provide support in footwear. Exemplary structures for which support columns 32 can be substituted are found in U.S. Pat. Nos. 7,314,125; 6,898,870; and 6,964,120; and U.S. patent application Ser. Nos. 11/966,513; 11/459,180; 11/459,093; 11/422,138; 11/419,015; 11/287,474; 10/949,813; 10/926,080; and 09/754,022; each of which is incorporated herein in its entirety for all purposes.

It is to be appreciated that each bladder 34 may have one or more properties that are different from one or more properties of some or all of the other bladders 34. For example, the geometry of the bladders 34 may differ with respect to some or all of the other bladders 34. In certain embodiments, the height, or circumference, or diameter (or all three parameters) of any particular bladder 34 may be different than one or more other bladders 34. The pressure within bladders 34 can vary as well, and can be altered dependent on usage or needs; for example, certain types of footwear with high impact uses such as basketball and running footwear may have a higher pressure within its bladders 34 than footwear with lower impact uses such as walking or golf footwear. In other embodiments, the pressure within one or more bladders 34 can be adjusted to have a value different than that of one or more other bladders 34. Thus, in certain embodiments, the bladders 34 that form a particular support column 32 could be identical with one another, yet have one or properties that are different from other bladders 34 in other support columns 32. In other embodiments the bladders 34 in a particular support column 32 may be different, thereby allowing, for example, an upper bladder 34 to be softer than a harder lower bladder 34 in the support column, which can enhance performance and comfort in particular situations. In this manner, the performance and comfort of sole assembly 14 and, therefore, footwear 10 can be optimized for an individual or for a particular activity, for example.

A variety of thermoplastic polymer materials may be utilized for bladder 34, including polyurethane, polyester, polyester polyurethane, and polyether polyurethane. Another suitable material for bladder 34 is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Bladder 34 may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

The fluid within bladder 34 may be any of the gasses disclosed in U.S. Pat. No. 4,340,626 to Rudy, hereby incorporated by reference, such as hexafluoroethane and sulfur hexafluoride, for example. The fluid may also include gasses such as pressurized octafluorapropane, nitrogen, or air. In addition to gasses, various gels or liquids may be sealed within bladder 34. Accordingly, a variety of fluids are suitable for bladder 34. With regard to pressure, a suitable fluid pressure is 20 pounds per square inch, but may range from one to thirty-five pounds per square inch. Accordingly, the fluid pressure within bladder 34 may be relatively high, or the fluid pressure may be slightly elevated from ambient in some embodiments of the invention.

Tensile member 38 may be formed as a textile structure that includes a first wall 46, a second wall 48, and a plurality of connecting members 50 anchored to each of first wall 46 and second wall 48. First wall 46 is spaced away from second wall 48, and connecting members 50 extend between first wall 46 and second wall 48 to retain a substantially constant spacing between walls 46 and 48. First wall 46 is bonded to first barrier layer 40, and second wall 48 is bonded to second barrier layer 42. In this configuration, the pressurized fluid within the chamber formed by barrier 36 places an outward force upon barrier layers 40 and 42 and tends to move barrier layers 40 and 42 apart. The outward force supplied by the pressurized fluid, however, extends connecting members 50 and places connecting members 50 in tension, which restrains further outward movement of barrier layers 40 and 42. Accordingly, tensile member 38 is bonded to the interior surfaces of bladder 34 and limits the degree to which barrier layers 40 and 42 may move apart upon pressurization of bladder 34. As an alternative to the textile structure, tensile member 38 may also be a foam member located within bladder 34 to limit the degree to which barrier layers 40 and 42 may move apart upon pressurization.

Figure 3:
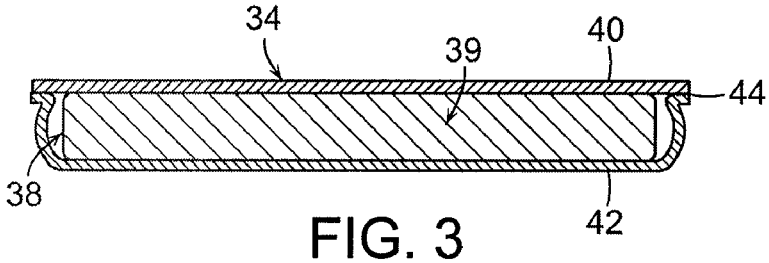
FIG. 3 is a sectional view of an alternative embodiment of a fluid-filled bladder of the article of footwear of FIG. 1.
Figure 4:
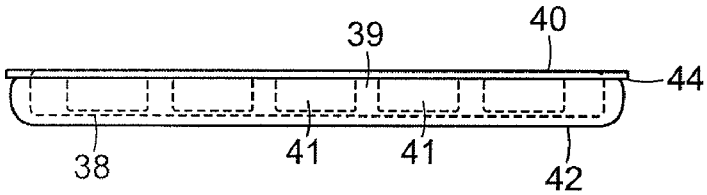
FIG. 4 is a sectional view of an alternative embodiment of the fluid-filled bladder of FIG. 3.

In other embodiments, tensile member 38 may be formed of a foam element 39 that is positioned between and bonded to first barrier layer 40 and second barrier layer 42, as illustrated in FIG. 3 which limits the degree to which barrier layers 40 and 42 may move apart upon pressurization. In certain embodiments, as illustrated in FIG. 4, foam element 39 may include a plurality of chambers 41 extending therethrough.

Exemplary tensile members made of foam elements are described in U.S. Pat. No. 7,131,218; U.S. Patent Publication No. 2005/0167029; and U.S. Patent Publication No. 2007/0063368, each of which is incorporated herein by reference in their entirety for all purposes.

A variety of techniques may be utilized to bond tensile member 38 to each of first barrier layer 40 and second barrier layer 42. For example, a layer of thermally activated fusing agent may be applied to first wall 46 and second wall 48. The fusing agent may be a sheet of thermoplastic material, such as thermoplastic polyurethane, that is heated and pressed into contact with first wall 46 and second wall 48 prior to placing tensile member 38 between barrier layers 40 and 42. The various elements of bladder 34 are then heated and compressed such that the fusing agent bonds with barrier layers 40 and 42, thereby bonding tensile member 38 to barrier 38.

Alternately, a plurality of fusing filaments may be integrated into first wall 46 and second wall 48. The fusing filaments are formed of a material that will fuse, bond, or otherwise become secured to barrier layers 40 and 42 when the various components of bladder 34 are heated and compressed together. Suitable materials for the fusing filaments include, therefore, thermoplastic polyurethane or any of the materials that are discussed above as being suitable for barrier layers 40 and 42. The fusing filaments may be woven or otherwise mechanically manipulated into walls 46 and 48 during the manufacturing process for tensile element 38, or the fusing filaments may be subsequently incorporated into walls 46 and 48.

Figure 5:
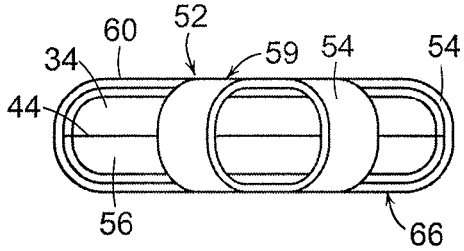
FIG. 5 is an elevation view of a fluid-filled bladder of the article of footwear of FIG. 1, enclosed within a retaining member.
Figure 6:
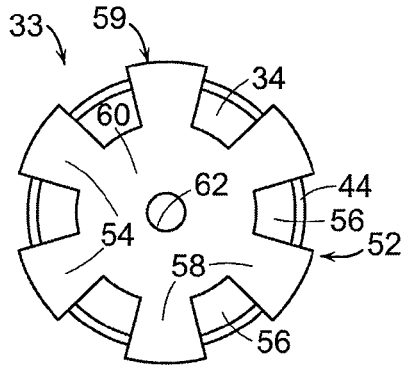
FIG. 6 is a top plan view of the fluid-filled bladder of FIG. 5.
Figure 7:
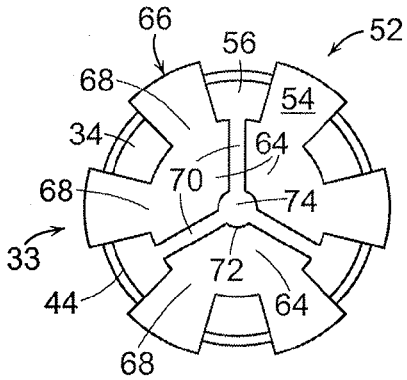
FIG. 7 is a bottom plan view of the fluid-filled bladder of FIG. 5.

Each fluid-filled bladder 34 is housed within a retaining member 52, seen more clearly in FIGS. 5-7. Retaining member 52 acts as a cage to capture or retain fluid-filled bladder 34 therein, and provides abrasion resistance for bladder 34. Retaining members 52 may be secured to top plate 30 and bottom plate 32 with adhesive, welding, mechanical fasteners, or any other suitable fastening means.

Retaining member 52 includes a plurality of strips or panels 54 extending from above first barrier layer 40, vertically along the sidewall of fluid-filled bladder 34, and then below second barrier layer 42. Panels 54 are spaced from one another about the periphery of fluid-filled bladder 34, thereby providing gaps 56 between adjacent panels 54. In the illustrated embodiment, retaining member 52 includes six (6) panels 54 and six corresponding gaps 56, however, it is to be appreciated that retaining member 52 can be provided with any number of panels 54 and corresponding gaps 56.

Encasing fluid-filled bladder 34 within retaining member 52 is advantageous in that it provides a resilient member that returns a significant amount of incident energy to the user. Certain embodiments of the support assembly 33 can return as much as 90% of the incident energy to the user. Retaining member 52 also advantageously protects fluid-filled bladder 34 against shear forces, and prevents fluid-filled bladder 34 from "bottoming out" in high impact force situations.

First ends 58 of panels 54 are connected at a first side 59 of retaining member 52 to a first plate 60, which is seated above first barrier layer 40 when fluid-filled bladder 34 is seated in retaining member 52. In certain embodiments, panels 54 and first plate 60 are of unitary, that is one-piece, construction. In the illustrated embodiment, first plate 60 has a substantially circular shape, but is not intended to be so limited. It is to be appreciated that first plate 60 can have any desired shape. First plate 60 has a central aperture 62 formed therein.

A plurality of second plates 64 are provided on a second side 66. Second ends 68 of panels 54 are connected to second plates 64. In certain embodiments, each plate 64 has two second ends 68 of adjacent panels 54 secured thereto. In the illustrated embodiment, where there are six panels 54, there are three second plates 64. In certain embodiments, panels 54 and second plates 64 are of unitary, that is one-piece, construction.

Gaps or channels 70 are provided between adjacent second plates 64. In the illustrated embodiment, there are three channels 70, spaced approximately 120° from one another. Each second plate 64 has a curved recess 72 provided at a radially interior portion thereof. The curved recesses 72 combine to define a substantially circular central aperture 74 in a central portion of second side 66.

By providing second side 66 with multiple second plates 64 and channels 70, second side 66 has enough flexibility to allow retaining member 52 to be released from its mold during manufacture, and allows easier insertion of fluid-filled bladder 34 into retaining member 52.

Figure 8:
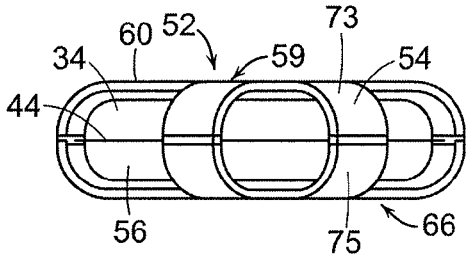
FIG. 8 is an elevation view of an alternative embodiment of the retaining member of FIG. 5.

In certain embodiments, retaining member 52 need not be a unitary structure, and may be formed of multiple components. For example, as seen in FIG. 8, retaining member 52 may be formed of an upper portion 73 and a lower portion 75, which are secured to one another by adhesive, welding, or any other suitable fastening means.

It is to be appreciated that each retaining member 52 may have one or more properties that are different from one or more properties of some or all of the other retaining members 52. In certain embodiments, the geometry of the retaining members 52 may differ with respect to some or all of the other retaining members 52. For example, the size, arrangement, and number of panels forming retaining members 52 may be different than one or more other bladders 34. Thus, by varying the geometry or construction of retaining members 52, the performance and comfort of sole assembly 14 and, therefore, footwear 10 can be fine tuned and optimized for an individual or for a particular activity.

Figure 9:
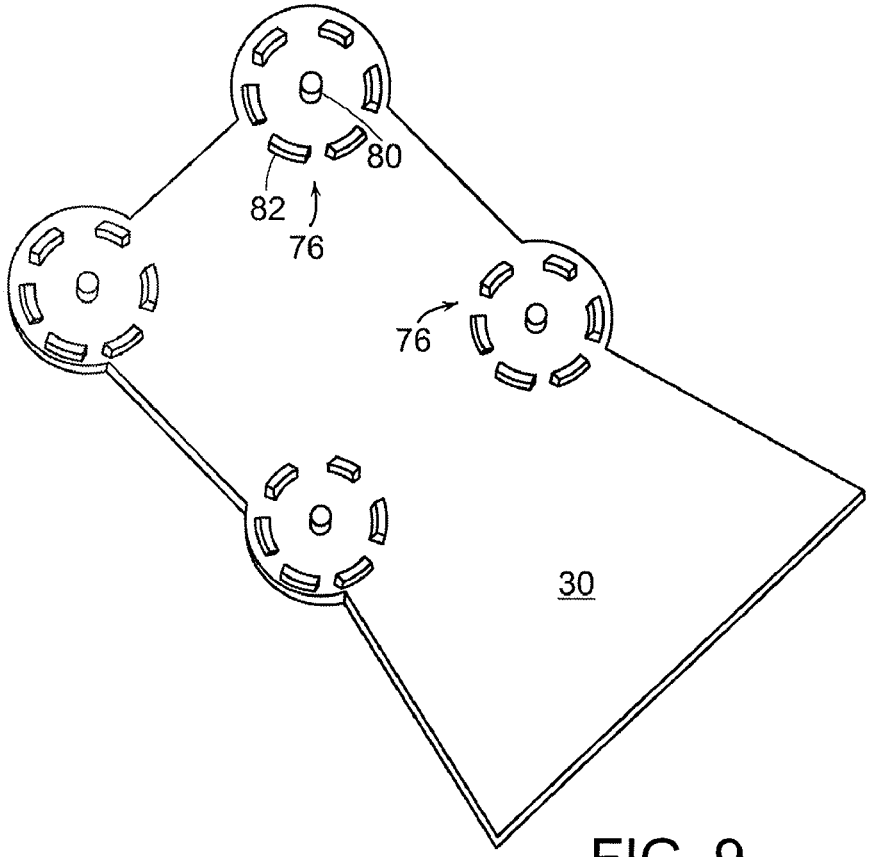
FIG. 9 is a perspective view of a top plate of the article of footwear of FIG. 1.

As seen in FIG. 9, top plate 30 includes a plurality of first sets 76 of projections. Each first projection set 76 is configured to mate with a corresponding retaining member 52 to help align and register retaining member 52 with respect to top plate 30. In the illustrated embodiment, each top plate 30 has four first projection sets 76, which correspond with the four retaining members 52. It is to be appreciated that any number of first projection sets 76 can be provided on top plate 30.

Figure 10:
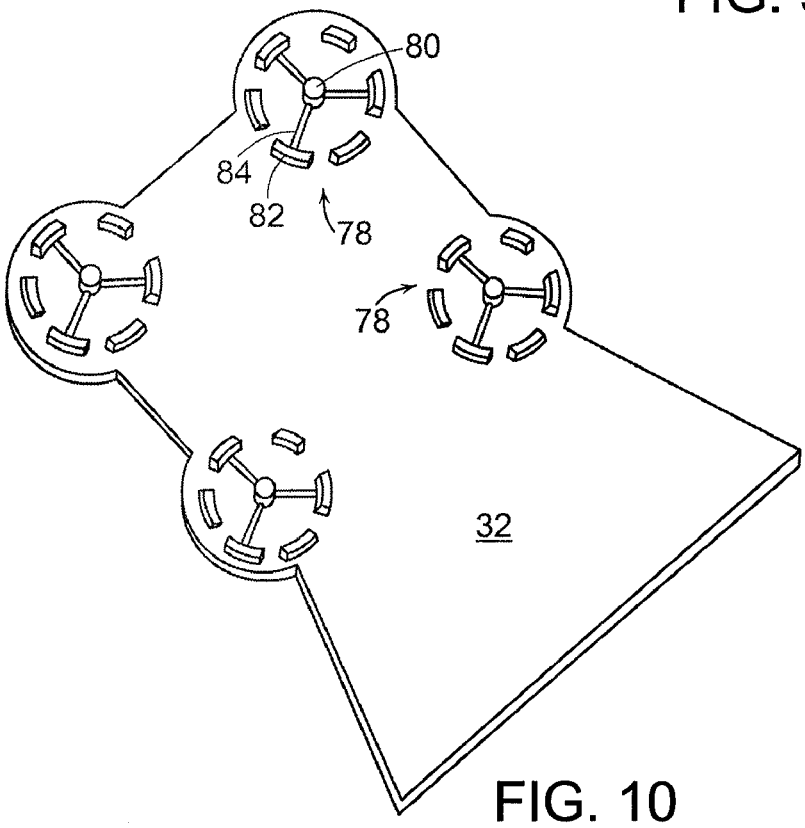
FIG. 10 is a perspective view of a bottom plate of the article of footwear of FIG. 1.

As seen in FIG. 10, bottom plate 32 includes a plurality of second sets 78 of projections. Each second projection set 78 is configured to mate with a corresponding retaining member 52 to help align and register retaining member 52 with respect to bottom plate 32. In the illustrated embodiment, each bottom plate 32 has four second projection sets 78, which correspond with the four retaining members 52. It is to be appreciated that any number of second projection sets 78 can be provided on top plate 30.

As seen in FIGS. 9-10, each projection set 76, 78 includes a central projection 80 extending outwardly from the surface of the plate. In the illustrated embodiment, central projections 80 have a substantially circular cross-section. Central projection 80 of top plate 30 engages central aperture 62 of retaining member 52. Similarly, central projection 80 of bottom plate 32 engages central aperture 74 of retaining member 52.

Each projection set 76, 78 includes a plurality of ribs 82 extending circumferentially around central projection 80. Ribs 82 are generally arc-shaped and are spaced from one another circumferentially around central projection 80 so as to generally define a circle about central projection 80. Each rib 82 of top plate 30 is seated within a gap 56 between corresponding adjacent panels 54 and adjacent an outer peripheral edge of first plate 60. Similarly, each rib 82 of bottom plate 32 is seated within a gap 56 between corresponding adjacent panels 54 and adjacent an outer edge of a corresponding second plate 64.

A plurality of radial ribs 84 is provided on bottom plate 32, with each radial rib 84 extending outwardly from central projection 80 to a rib 82. Each radial rib 84 is seated in a corresponding channel 70 between adjacent second plates 64.

Consequently, the engagement of central projections 80 with central apertures 62, 74 and the engagement of ribs 82 within gaps 56 and between panels, as well as the engagement of radial ribs 84 with channels 70 helps to align and register retaining member 52 properly between top plate 30 and bottom plate 32.

It is to be appreciated that in certain embodiments, that first side 59 of retaining member 52 could engage bottom plate 32 rather than top plate 30 and that second side 66 could engage top plate 30. In such an embodiment, radial ribs 84 would necessarily be provided on top plate 30 to engage channels 70 on second side 66 of retaining member 52.

Figure 11:
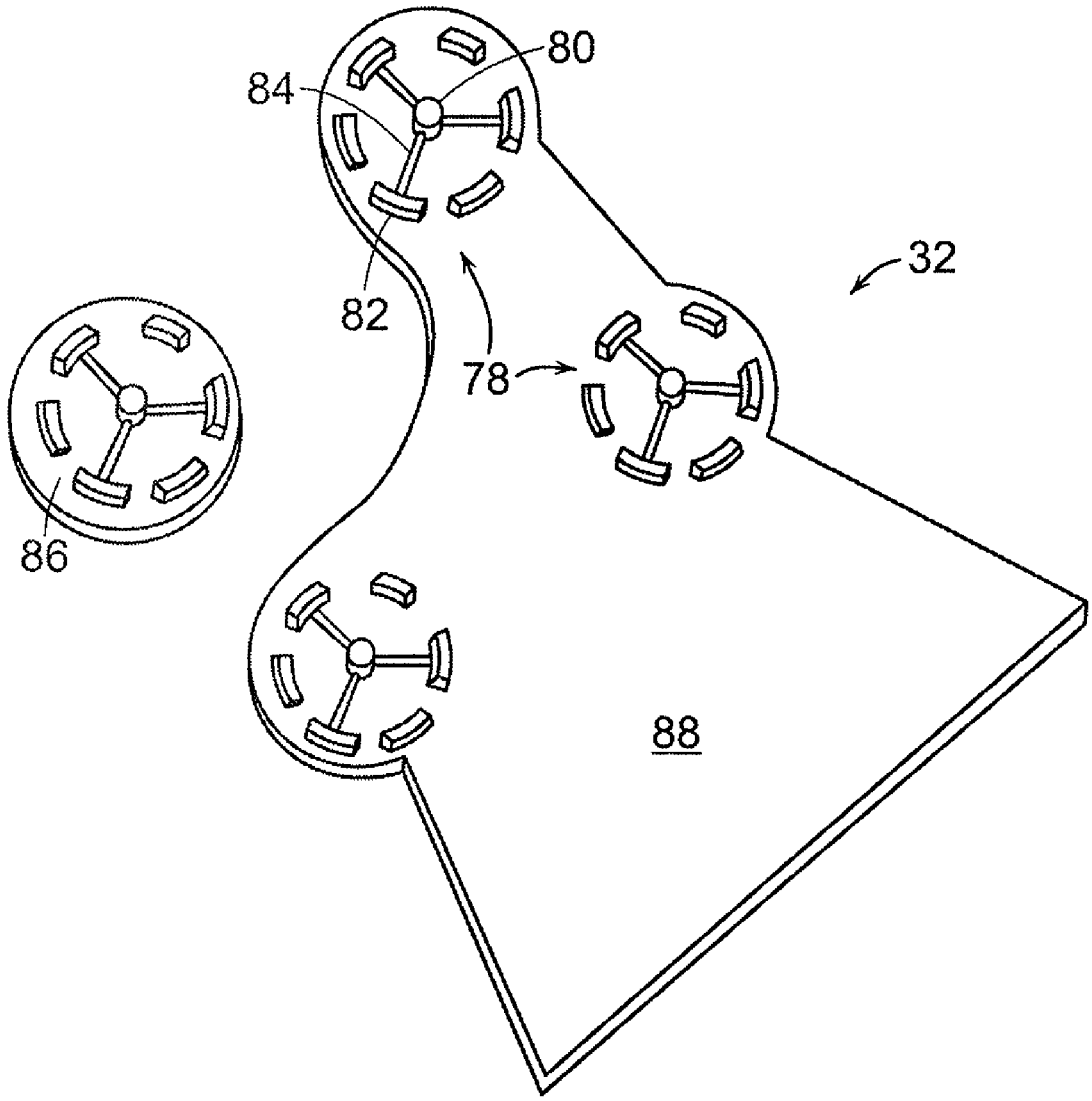
FIG. 11 is a perspective view of an alternative embodiment of the bottom plate of the article of footwear of FIG. 1.

In certain embodiments, bottom plate 32 may be formed of more than one portion. For example, as shown in FIG. 11, bottom plate 32 may include a first portion 86 and a second portion 88. In the illustrated embodiment, first portion is positioned beneath and supports the rearmost lateral retaining member 52, while second portion 88 is positioned beneath and supports the remaining retaining members 52.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising, in combination:
an upper; and
a sole assembly secured to the upper and comprising:
a top plate;
a bottom plate positioned below the top plate;
a plurality of support assemblies extending between the top plate and the bottom plate, each support assembly comprising a fluid-filled bladder and a retaining member extending across a top surface, a bottom surface, and sides of the fluid-filled bladder.

2. The article of footwear of claim 1, wherein each retaining member includes a plurality of panels spaced from one another defining gaps therebetween and connected at first ends thereof to a first plate on a first side of the retaining member and at second ends thereof to one of a plurality of second plates on a second side of the retaining member.

3. The article of footwear of claim 2, wherein each of the top plate and the bottom plate includes a plurality of sets of projections, and each of the first plate and the second plate includes a central aperture, each central aperture receiving one of the projections of one of the top plate and the bottom plate, and each of the gaps receiving a projection of the top plate and a projection of the bottom plate.

4. The article of footwear of claim 3, wherein each set of projections includes a central projection and a plurality of arc-shaped ribs surrounding the central projection, each rib being received in one of the gaps.

5. The article of footwear of claim 4, wherein the sets of projections of one of the top plate and the bottom plate include a plurality of radially extending ribs, each radially extending rib connected at a first end thereof to one of the central projections and at a second end thereof to one of the arc-shaped ribs.

6. The article of footwear of claim 5, wherein one of the first plate and the second plate includes a plurality of radially extending channels, each channel receiving one of the radially extending ribs.

7. The article of footwear of claim 2, wherein each second plate is connected to a pair of panels.

8. The article of footwear of claim 1, wherein the top plate and the bottom plate extend rearwardly from a midfoot portion of the sole assembly to a heel portion of the sole assembly.

9. The article of footwear of claim 1, further comprising an outsole secured to a lower surface of the bottom plate.

10. The article of footwear of claim 1, wherein the sole assembly includes four support assemblies.

11. The article of footwear of claim 1, wherein the sole assembly includes:
a first support assembly positioned in a lateral rear portion of a heel portion of the sole assembly
a second support assembly positioned in a medial rear portion of the heel portion of the sole assembly;
a third support assembly positioned in a medial forward portion of the heel portion of the sole assembly; and
a fourth support assembly positioned in a lateral forward portion of the heel portion of the sole assembly.

12. The article of footwear of claim 1, wherein each bladder has a first surface, an opposed second surface, and a tensile member joined to the first and second surfaces.

13. The article of footwear of claim 12, wherein the tensile member is formed from a textile material.

14. The article of footwear of claim 12, wherein the tensile member is formed from a textile material that includes a first wall bonded to the first surface, a second wall bonded to the second surface, and a plurality of connecting members extending between the first wall and the second wall.

15. The article of footwear of claim 1, wherein the fluid-filled bladder encloses a pressurized fluid.

16. The article of footwear of claim 1, further comprising a midsole positioned between the upper and the top plate.

17. An article of footwear comprising, in combination:

an upper; and a sole assembly secured to the upper and comprising:

a top plate having a plurality of projections on a lower surface thereof;

a bottom plate positioned below the top plate and having a plurality of projections on an upper surface thereof;

a plurality of support assemblies extending between the top plate and the bottom plate, each support assembly comprising:

a fluid-filled bladder having a first surface, an opposed second surface, and a tensile member joined to the first and second surfaces; and a retaining member comprising a plurality of panels spaced from one another and defining gaps therebetween, each panel being connected at a first end thereof to a first plate and at second ends thereof to one of a plurality of second plates, the retaining member surrounding the fluid-filled bladder, the first plate having a central aperture therein, each of the second plates having a recess, the recesses defining a central aperture.

18. The article of footwear of claim 17, wherein each of the top plate and the bottom plate includes a central projection and plurality of arc-shaped projections disposed about the central projection, each central projection being received in one of the central apertures of the first plate and the second plate, and each arc-shaped projection being received in one of the gaps.

19. The article of footwear of claim 17, wherein the tensile member is formed from a textile material that includes a first wall bonded to the first surface, a second wall bonded to the second surface, and a plurality of connecting members extending between the first wall and the second wall.

20. The article of footwear of claim 17, further comprising an outsole secured to a lower surface of the bottom plate.

21. The article of footwear of claim 17, further comprising a midsole positioned between the upper and the top plate.

22. An article of footwear comprising, in combination:

an upper;

a sole assembly secured to the upper and comprising:

a top plate having a plurality of projections on a lower surface thereof;

a bottom plate positioned below the top plate and having a plurality of projections on an upper surface thereof;

a plurality of support assemblies extending between the top plate and the bottom plate, each support assembly comprising:

a fluid-filled bladder having a first surface, an opposed second surface, and a tensile member joined to the first and second surfaces, the tensile member being formed from a textile material that includes a first wall bonded to the first surface, a second wall bonded to the second surface, and a plurality of connecting members extending between the first wall and the second wall;

a retaining member comprising a plurality of panels spaced from one another and defining gaps therebetween, each panel being connected at a first end thereof to a first plate and at second ends thereof to one of a plurality of second plates, the retaining member surrounding the fluid-filled bladder, the first plate having a central aperture therein, each of the second plates having a recess, the recesses defining a central aperture; and an outsole secured to a lower surface of the bottom plate.

23. The article of footwear of claim 22, further comprising a midsole positioned between the upper and the top plate.

* * * * *